United States Patent [19]

Perrott

[11] 4,449,882

[45] May 22, 1984

[54] APPARATUS FOR CARRYING EMPTY CARGO CONTAINERS

[75] Inventor: Lynn F. Perrott, Portland, Oreg.

[73] Assignee: Scott S. Corbett, Jr., Portland, Oreg. ; a part interest

[21] Appl. No.: 380,051

[22] Filed: May 20, 1982

[51] Int. Cl.[3] ..... B66F 9/14

[52] U.S. Cl. ..... 414/665; 294/81 SF; 414/608; 414/663; 414/785; 414/912

[58] Field of Search ..... 414/607, 608, 619, 620, 414/621, 623, 663, 785, 668, 669, 664, 665; 294/81 SF, 67 AA

[56] References Cited

U.S. PATENT DOCUMENTS

| | | | |
|---|---|---|---|
| 3,499,563 | 3/1970 | Forrey et al. | 414/608 |
| 3,669,290 | 6/1972 | Doyle | 294/81.51 X |
| 4,090,628 | 5/1978 | Sinclair | 414/621 X |
| 4,095,714 | 6/1978 | Schuster | 414/607 |
| 4,234,287 | 10/1980 | Lässig et al. | 212/182 X |
| 4,354,794 | 10/1982 | Macnab | 294/81.1 X |

*Primary Examiner*—Joseph E. Valenza
*Assistant Examiner*—Stuart Millman
*Attorney, Agent, or Firm*—Oliver D. Olson

[57] ABSTRACT

The cargo container carrier of this invention is configured to be removably attachable to the carriage structure of a conventional lift truck. The assembly comprises a vertically extensible main frame secured to the lift truck carriage, the frame pivotally supporting a first pair of tiltable container lifting beam sections for adjustment between an operative position in which they are in longitudinal extension, for engaging an empty cargo container for transport, and an inoperative position in which they extend along the lateral sides of the lift truck in order to allow for increased manueverability of the vehicle while not functioning in the transporting of cargo containers, and for operation of the lift truck in conventional uses and in confined spaces. For use with longer cargo containers, the assembly includes a second pair of longer lifting beam sections arranged for adjustment between an operative position in which they are in longitudinal extension, and an inoperative position in which they extend along the lateral sides of the lift truck, the longer beam sections being arranged to overlie and to be secured to the first pair of beam sections when the latter are locked in extended, operative position.

20 Claims, 7 Drawing Figures

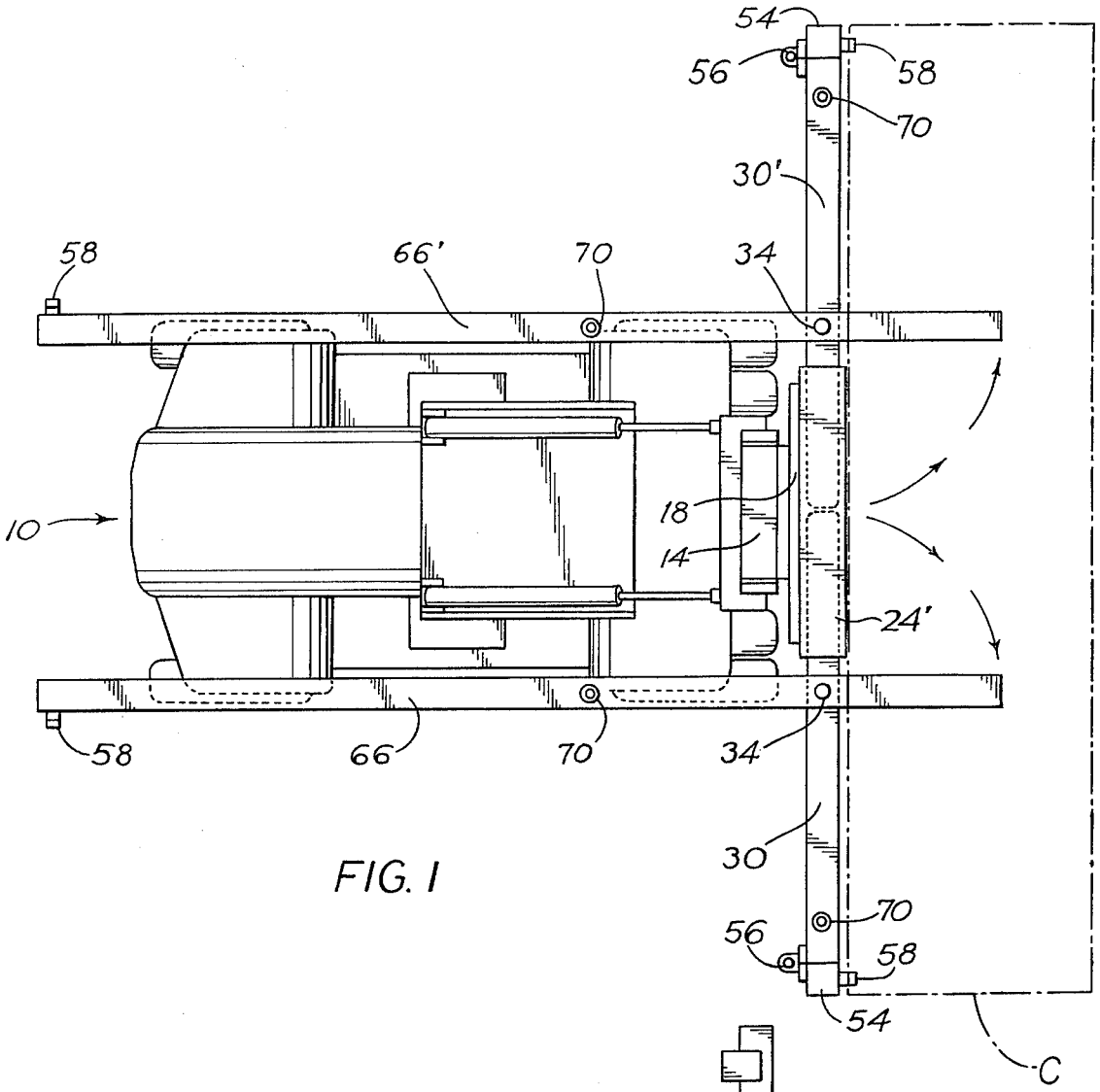
FIG. 1
FIG. 2
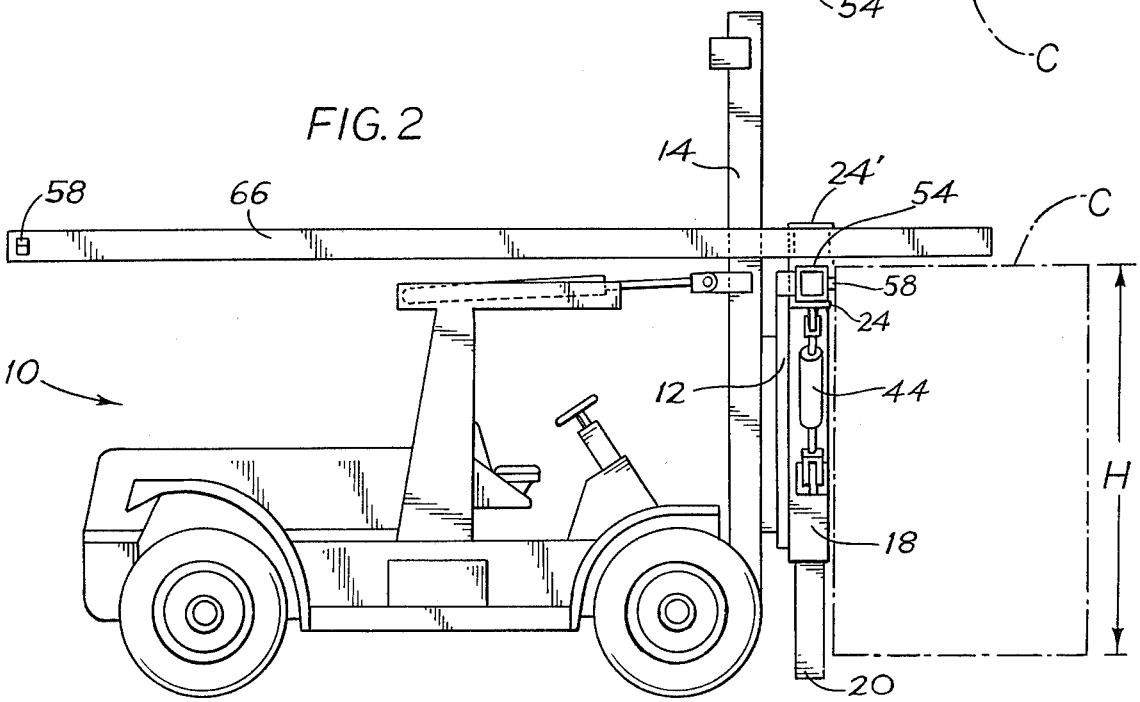

L
L'
10
12
14
16
18
20
22
24
24'
26
26'
28
30
30'
32
34
36
38
40
40'
42
42'
44
46
48
50
52
54
56
58
60
62
64
66
66'
68
70
72
5
6
7

APPARATUS FOR CARRYING EMPTY CARGO CONTAINERS

BACKGROUND OF THE INVENTION

This invention relates to apparatus for lifting, transporting and stacking empty cargo containers, and more particularly to such apparatus which is removably attachable to lift truck carriages and is capable of performing such functions with different length cargo containers.

It is the general practice to store empty cargo containers in a vertically stacked condition at railroad and shipping yards prior to their being moved for further use.

Apparatus for lifting, transporting and stacking empty cargo containers have been provided heretofore, as fixed or removable attachments to conventional lift trucks. However, they are characterized by complex structures which includes lifting beams which permanently extend laterally from the sides of a lift truck even while not functioning in the operations associated with containers.

Therefore, the manueverability of the vehicle is considerably limited, precluding use of the vehicle in other conventional duties which require operation in confined areas.

Understandably, for the lift truck to provide other duties, either a great deal of lateral clearance must be afforded the vehicle, or considerable labor time must be spent in removing the container lifting apparatus from the truck, should it be provided for removable attachment, or considerable investment is required for separate vehicles for performing different functions. In any of the above, excessive operational and/or space costs relating to the operation of the yard are incurred.

SUMMARY OF THE INVENTION

In its basic concept, the empty container carrying apparatus of this invention is removably attachable to the carriage of a conventional lift truck, and includes a lifting beam provided in two sections arranged to be locked together in longitudinal extension and, when unlocked, to be rotated to positions extending along the opposite sides of the lift truck.

It is by virtue of the foregoing basic concept that the principal objective of this invention is achieved; namely, to overcome the aforementioned disadvantages and limitations of cargo container transporting apparatus of the prior art.

Another object of this invention is the provision of cargo container carrying apparatus of the class described which includes a second, longer lifting beam for use with longer cargo containers, the beam being configured in two sections arranged to be locked together in longitudinal extension and, when unlocked, to be rotated to positions extending along the opposite sides of the lift truck.

Another object of this invention is the provision of apparatus of the class described which is tiltably adjustable to varying degrees of angulation relative to the lift truck, the tilting mechanism being arranged additionally to provide support for the outer portions of the two sections of the lifting beams.

A further object of this invention is the provision of apparatus of the class described which, by virtue of its construction, affords conventional use and full manueverability of the lift truck to which it is attached when not functioning in the transporting of cargo containers.

A still further object of this invention is the provision of apparatus of the class described which is of simplified construction for economical manufacture.

BRIEF DESCRIPTION OF THE DRAWINGS

FIG. 1 is a plan view of a lift truck with container carrying apparatus of this invention attached to the vertically movable carriage, the shorter, main lifting beam sections illustrated in extended, operative position, and the longer lifting beam sections shown in inoperative, retracted position along the sides of the lift truck.

FIG. 2 is a side elevation of the lift truck and container carrying apparatus of FIG. 1, as viewed from the bottom in FIG. 1.

DESCRIPTION OF THE PREFERRED EMBODIMENT

Figures 3, 4, 5, 6, 7:
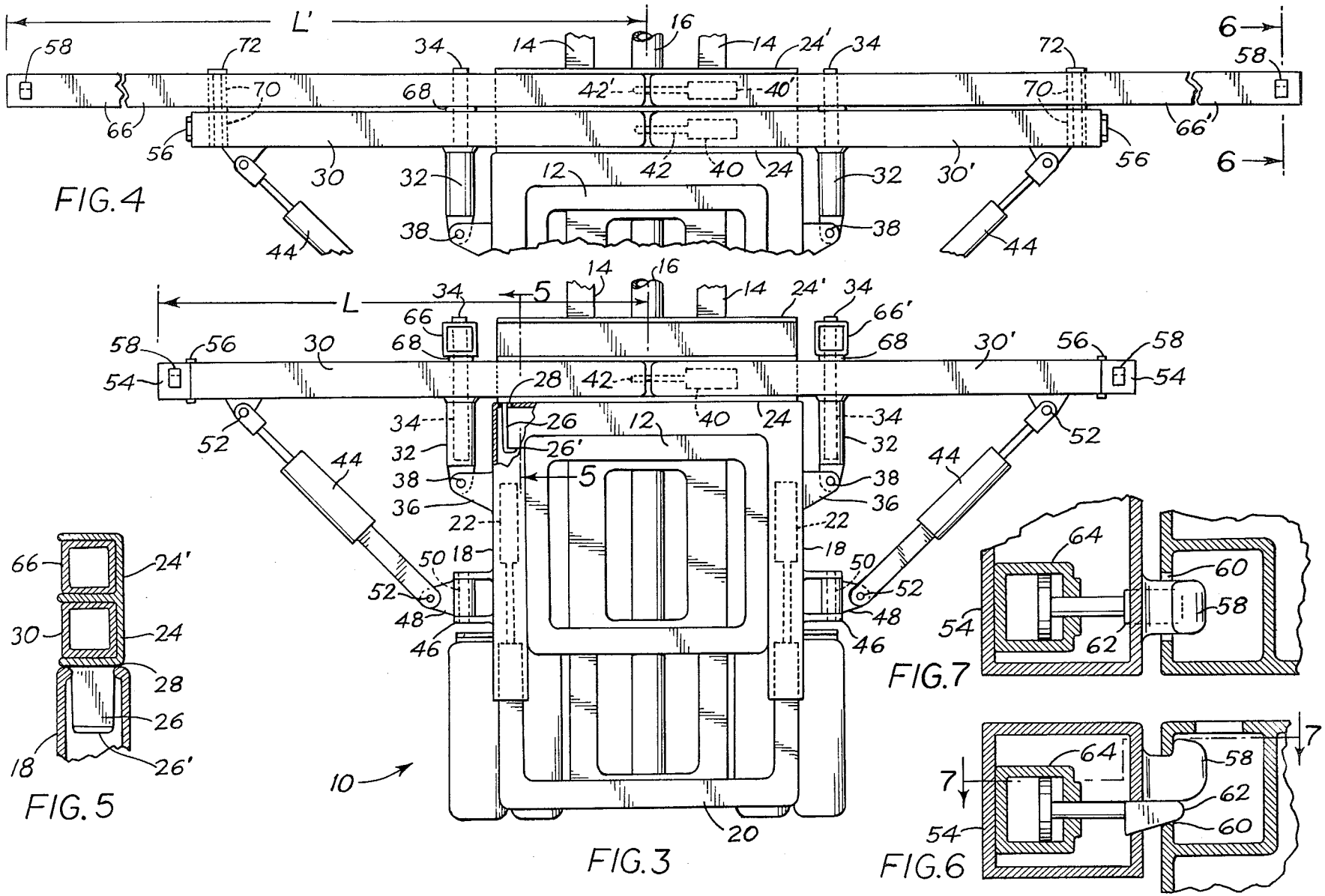
FIG. 3 is a fragmentary front elevation as viewed from the right in FIG. 1.
FIG. 4 is a foreshortened, fragmentary front elevation of the assembly of FIG. 3 showing the longer lifting beam sections in operational position overlying and secured to the shorter lifting beam sections.
FIG. 5 is a fragmentary sectional view of the beam support channel assembly and the tilt limiter associated therewith, taken on the line 5—5 in FIG. 3.
FIG. 6 is a fragmentary sectional view of a container hook and lock assembly associated with each beam section, this view taken along the line 6—6 in FIG. 4.
FIG. 7 is a fragmentary horizontal section of the container hook assembly taken along the line 7—7 in FIG. 6.

A conventional lift truck 10 includes a carriage 12 mounted for vertical movement relative to vertically extendable mast 14 both of which are driven by elongated drive cylinder 16, all as shown in FIGS. 1–3.

The apparatus of this invention includes a fixed main frame 18 removably mounted to the carriage 12, the lower portion 20 of the main frame being adjustable vertically relative to the fixed portion 18, by adjusting piston-cylinder units 22. This vertical adjustment is provided in order to accommodate cargo containers C of different heights H (FIG. 2).

A reinforcing channel 24, double U-shape in cross section and best illustrated in FIGS. 3, 4 and 5, overlies the top portion of the frame 18. Means for defining the limits of vertical movement of the reinforcing channel relative to the frame is provided by L-shaped tilt limiters 26 which are mounted to the lower ends of the channel 24 and extend freely downward into the main frame 18 through slotted openings 28. The lower ends 26' of the limiters 26 are offset angularly inward so as not to be able to pass through the slotted openings provided in the main frame. The limiters thus are secured to the main frame for vertical movement through a limited range.

A main lifting beam, provided in two longitudinally extending sections 30 and 30', is arranged with one end portion of each section removably captured in the lower reinforcing channel 24, as shown in FIG. 3. Means for pivotally supporting each section is provided by laterally spaced, vertically extending pivot sockets 32 which receive pivot shafts 34 secured to each beam section intermediate the ends of the latter. Each pivot socket 32 is pivotally supported by the frame 18 on flanges 36 by pivot pin 38, thereby allowing for angular movement of the sockets 32 relative to the frame.

Means for releasably locking the lifting beam sections together in longitudinal extension is provided by a hydraulic piston-cylinder unit 40 secured adjacent the inner end of one section. The cylinder piston rod forms a locking pin 42 arranged for removable registry with an opening (not shown) provided in the inner end of the opposite section.

Means for varying the angular disposition of the joined lifting beam sections laterally relative to the frame 18 and for support of the outer portions of the beam sections is provided by beam tilt piston-cylinder units 44 pivotally interengaging the frame 18 and the outer end portion of each lifting beam section, as best shown in FIG. 3. The mounting tabs 46 on the frame provide for rotation of mounting flange 48 about pivot pin 50 which is aligned axially with pivot shaft 34. This arrangement allows the connected tilt cylinders 44 to be rotated about the same axis as the pivot shafts 34 of the associated lifting beam sections. The piston-cylinder units 44 are mounted to the beam sections and the mounting flanges 48 by pivot pins 52, allowing for varying the angular disposition of the cylinders relative to the beam and the frame.

The separate, outer terminal end portion 54 of each section of the main lifting beam is arranged, as by hinge 56, for pivotal movement to a retracted position behind the lifting beam, as best shown in FIG. 4. The outer, terminal end portion 54 of each beam section incorporates a conventional container hook 58 (FIGS. 6 and 7) for retractably entering a hook catch opening 60 in a lifting fixture in each end of a cargo container. A hook lock finger 62, operated by piston-cylinder unit 64, in each end portion 54, is arranged to retractably intercept the opening 60, as shown in FIG. 6. Thus, the hook is prevented from moving to a position disengaging from the container during transit.

The lifting apparatus described herein includes a longer lifting beam for use with longer, but still standard cargo containers. For example, the main beam sections 30, 30' may be dimensioned in length L (FIG. 3) for use with standard 20 foot long cargo containers, while the longer beam sections may be dimensioned in length L' (FIG. 4) for use with standard 40 foot long containers. This lifting beam is illustrated as being provided in two longitudinally extending sections 66 and 66', arranged with one end portion of each section capable of being removably captures in the upper reinforcing channel 24', as best shown in FIG. 4. In this position the inner ends of the beam sections are secured together by a hydraulic piston-cylinder unit 40', 42', as previously described.

The beam sections 66 and 66' are rotatably supported by pivot shafts 34 which extend vertically upward beyond the beam sections 30 and 30'. Each pivot shaft thus provides a common axis of rotation for both the main and the associated longer lifting beam sections. As illustrated in FIGS. 3 and 4, a bearing pad 68 is interposed between the main and longer lifting beam sections at the pivot point 34 of the beams, thereby reducing the area of frictional contact between the beam sections for rotation. The pad 68 is configured equal in height to the center flange of the dual channels 24 and 24'.

Lock means is arranged in releasably secure the main lifting beam sections and their respective longer lifting beam sections together when they are disposed in the same vertical plane. While a variety of locking means may be utilized, for purposes of illustration the associated beam sections 30, 66 and 30',66' are shown to incorporate sleeves 70 arranged for vertical alignment when both sections are in their operative, extended position, as shown in FIG. 4. A locking pin 72 is configured to be manually inserted through the aligned sleeves 70, thus releasably securing the associated lifting beam sections in vertical alignment. This arrangement not only secures the beam sections together in vertically stacked arrangement, it also utilizes the strength of the shorter beam sections 30 and 30' to minimize the twisting of the longer beam sections when they are supporting a cargo container.

The longer lifting beam is thus arranged to be retractable between an extended position in which the beam sections 66 and 66', their inner end portions captured in the upper channel 24', extend laterally outward from the lift truck, the main lifting beam sections 30 and 30' providing support for the inner portion of the longer beam sections, and a retracted position in which, after removal of the locking pins 72, the longer beam sections are rotated about the pivots 34 to a position adjacent the opposite sides of the lift truck. The outer terminal end portions of the beam sections 66 and 66' include container hooks 58 and hook locks 62, as previously described.

The operation of the cargo container carrier is as follows: the carrier, which includes the adjustable main frame 18 mounting the pivoted lifting beam sections 30 and 30' and tilt cylinders 44, as described previously, is attached as by bolts to the carriage 12 of a lift truck 10, the carriage having had the forks conventionally connected thereto removed.

In the transporting of short, for example 20-foot cargo containers, the main beam sections 30 and 30' are secured together in longitudinal extension, by locking pin 42. The inner end portions of the beams are reinforced by the channel 24. The longer beam sections 66 and 66' preferably are retracted to the position illustrated in FIGS. 1 and 2.

The lift truck is manuevered to a position wherein the front of the truck is adjacent the side of the cargo container to be moved. The carriage 12 is adjusted until the hooks 58 are in registry with the associated catch openings 60 of the container lifting fixtures. If necessary, the lifting beam sections 30 and 30' may be tilted laterally, by means of cylinders 44 for aligning the hooks with the catches. The lift truck then is moved forward to engage the hooks 58 in the openings 60. The hook lock fingers 62 are operated to secure the container so that it will not become dislodged from the hooks during transit.

The adjustable section 20 of frame 18 is raised or lowered so as to bring the lower surface of the frame into registry with the bottom, strenghtened edge of the container, thereby providing a surface for the lower side of the container to rest against.

The carriage 12 of the lift truck is raised in conventional manner, thereby vertically raising the lifting assembly and the cargo container attached thereto. The tilt cylinders 44 may be operated as necessary to level the container. Vertical movement of one end or the other of the joined lifting beams during tilting is retracted by the tilt limiters 26 movably interlocking the reinforcing channel with the frame 18. As one cylinder 44 is operated to raise the associated end of the beam upward, the associated end of the reinforcing channel 24 is brought vertically upward until the lower projecting end 26' of the limiter 26 abuts the inside upper surface of the frame 18. The limiter prevents further upward movement and thus defines the maximum degree of tilt of the beam sections relative to the frame.

With the lifting beam and attached container leveled, the truck is manuevered to a predetermined unloading site, whereupon the assembly is lowered or raised, as required, to place the container on the ground, or to stack it upon one or more other containers previously deposited, or to place it upon a wheeled frame for connection to a tractor for over-the-road transportation. The hook lock 62 is released and the lifting beam assembly is lowered slightly to release the container hooks from the container catch openings 60. The lift truck then is retracted and is ready to receive another container.

The lifting beam sections 30 and 30' are arranged to be pivoted on shafts 34 after locking cylinder 40 is operated to withdraw locking pin 42 from the opening in the opposite beam section. By manually swinging the beam sections around the pivot shafts 34, the sections may be brought back adjacent the sides of the truck. Thus the truck may be used in confined areas for a variety of purposes.

For the transporting of 40-foot cargo containers, for example, the terminal end portion 54 of each main beam section is swung about hinge 56 to the back side of the associated beam section, and the beam sections 30 and 30' are pivoted about shafts 34 back under and into vertical alignment with the longer beam sections 66 and 66' positioned adjacent the opposite longitudinal sides of the lift truck. With the locking bores 70 thus vertically aligned, locking pins 72 are inserted into the bores, thereby releasably securing the beam sections together. The joined beam sections are then rotated about the common axis of pivots 34 until they are in fully extended, operative position. Locking cylinders 40 and 40' are operated to move locking pins 42 and 42' into engagement with the respective openings in the ends of beam sections 30 and 60. With the inner portions of the beam sections 66 and 66' captured in the upper channel 24' for support, and the longer beam supported by the main lifting beam, the lifting assembly is now ready for use with longer containers, in the same manner as described for the shorter containers.

It will be appreciated that with the lifting beams in retracted position, the lift truck forks may be reinstalled on the carriage for conventional lift truck operation. The only restriction to operation of the forks is that a load carried by the forks is limited in height by the farwardly projecting ends of the lifting beams.

Alternatively, the carrying apparatus described herein is configured also to accommodate the mounting to the lift truck carriage of a trailer frame carrying attachment as disclosed in applicant's copending patent application Ser. No. 412,504 filed Aug. 30, 1982, which is a continuation of Ser. No. 174,519, now abandoned filed Aug. 1, 1980 and entitled Wheeled Trailer Frame Carrying Unit Attachment For Lift Trucks. With both carrying units attached to the same lift truck carriage, the vehicle is capable of carrying and storing empty cargo containers, or alternatively transporting and storing wheeled trailer frames. With the lifting beams capable of assuming the retracted position described, the vehicle's use for such other purposes is enhanced by virtue of the markedly increased maneuverability afforded the vehicle, and thus its efficiency and utility is greatly increased.

It will be apparent to those skilled in the art that various changes may be made in the size, shape, type, number and arrangement of parts described hereinbefore. For example, the frame 18, 20 may be eliminated and the beam assembly mounted directly to the carriage of the lift truck 10 or any other suitable form of vehicle. This and other changes may be made without departing from the spirit of this invention and the scope of the appended claims.

Having thus described my invention and the manner in which it may be used, I claim:

1. For attachment to the vertically movable carriage of a lift truck or other vehicle, a cargo container carrier comprising:

(a) a main frame arranged for removable attachment to the vertically movable carriage of a vehicle, (b) laterally spaced, vertically extending pivot means mounted on said frame, (c) a container lifting beam configured in two sections each supported on one of said pivot means for pivotal adjustment of the beam sections between an operative position of longitudinal extension and a retracted position extending substantially parallel to each other adjacent opposite sides of the vehicle, (d) locking means on the beam sections for releasably securing them together in said operative position, and (e) container connecting means on the beam sections arranged to releasably engage a cargo container.

2. The cargo container carrier of claim 1 including extensible beam tilt means pivotally interconnecting the main frame and the outer portions of the beam sections and operable to vary the angular disposition of the lifting beam in operative position relative to the ground, the pivotal connection of the beam tilt means to the main frame being disposed on the same axis as the associated beam section pivot means whereby to allow pivoting of the beam sections between said operative and retracted positions.

3. The cargo container carrier of claim 1 including a reinforcing channel, U-shaped in cross section, overlying the main frame and arranged to capture the inner portions of the lifting beam sections when in operative position.

4. The cargo container carrier of claim 3 wherein the channel is movable vertically relative to the main frame for tilting the channel to vary the angular disposition of the lifting beam in operative position relative to the ground, and tilt limited means on said channel is arranged to engage said main frame to limit said angular disposition of the lifting beam relative to ground.

5. The cargo container carrier of claim 1 including a second lifting beam longer than the first named lifting beam, means mounting the second lifting beam over the first named lifting beam for support by the latter, and connecting means on the second lifting beam arranged to releasably engage a cargo container.

6. The cargo container carrier of claim 1 including:

(a) a second lifting beam longer than the first named lifting beam and configured in two sections one supported on each of said pivot means above the sections of the first named lifting beam for pivotal adjustment of the second beam sections between an operative position of longitudinal extension and a retracted position extending substantially parallel to each other adjacent opposite sides of the vehicle, (b) locking means on the second beam sections for releasably securing them together in said operative position, and (c) container connecting means on the second beam sections arranged to releasably engage a cargo container.

7. The cargo container carrier of claim 6 including a reinforcing channel, double U-shaped in cross section, overlying the main frame and arranged to capture the inner portions of the first and second named lifting beam sections when in operative position.

8. The cargo container carrier of claim 7 wherein the channel is movable vertically relative to the main frame for tilting the channel to vary the angular disposition of the lifting beams in operative position relative to the ground, the tilt limiter means on said channel is arranged to engage said main frame to limit said angular disposition of the lifting beams relative to ground.

9. The cargo container carrier of claim 7 including releasable connector means arranged to releasably interconnect the associated sections of the first and second lifting beams when they are in said operative position.

10. The cargo container carrier of claim 7 wherein the container connecting means on the first named lifting beam sections are arranged to be moved rearwardly of said sections when the sections of the second named lifting beam are to be used in said operative position.

11. A cargo container carrier comprising:

(a) a vehicle, (b) a carriage mounted to said vehicle for vertical movement, (c) laterally spaced, vertically extending pivot means on the carriage, (d) a container lifting beam configured in two sections each supported on one of said pivot means for pivotal adjustment of the beam sections between an operative position of longitudinal extension and a retracted position extending substantially parallel to each other adjacent opposite sides of the vehicle, (e) locking means on the beam sections for releasably securing them together in said operative position, and (f) container connecting means on the beam sections arranged to releasably engage a cargo container.

12. The carrier of claim 11 including extensible beam tilt means pivotally interconnecting the main frame and the outer portions of the beam sections and operable to vary the angular disposition of the lifting beam in operative position relative to the ground, the pivotal connection of the beam tilt means to the main frame being disposed on the same axis as the associated beam section pivot means whereby to allow pivoting of the beam sections between said operative and retracted positions.

13. The carrier of claim 11 including a reinforcing channel, U-shaped in cross section, overlying the main frame and arranged to capture the inner portions of the lifting beam sections when in operative position.

14. The carrier of claim 13 wherein the channel is movable vertically relative to the main frame for tilting the channel to vary the angular disposition of the lifting beam in operative position relative to the ground, and tilt limiter means on said channel is arranged to engage said main frame to limit said angular disposition of the lifting beam relative to ground.

15. The carrier of claim 11 including a second lifting beam longer than the first named lifting beam, means mounting the second lifting beam over the first named lifting beam for support by the latter, and connecting means on the second lifting beam arranged to releasably engage a cargo container.

16. The carrier of claim 11 including a second lifting beam longer than the first named lifting beam and configured in two sections one supported rotatably on each of said pivot means above the sections of the first named lifting beam, the beam sections arranged for releasable connection in longitudinal extension relative to each other and also for releasable connection to the associated sections of the first named lifting beam, the second lifting beam sections including container connecting means arranged to releasably engage a cargo container.

17. The carrier of claim 16 including a reinforcing channel, double U-shaped in cross section, overlying the main frame and arranged to capture the inner portions of the first and second named lifting beam sections when in operative position.

18. The carrier of claim 17 wherein the channel is movable vertically relative to the main frame for tilting the channel to vary the angular disposition of the lifting beams in operative position relative to the ground, and tilt limiter means on said channel is arranged to engage said main frame to limit said angular disposition of the lifting beam relative to ground.

19. The carrier of claim 17 including releasable connector means arranged to releasably interconnect the associated sections of the first and second lifting beams when they are in said operative position.

20. The carrier of claim 17 wherein the container connecting means on the first named lifting beam sections are arranged to be moved rearwardly of said sections when the sections of the second named lifting beam are to be used in said operative position.

* * * * *